US006268103B1

(12) United States Patent
Hopper et al.

(10) Patent No.: US 6,268,103 B1
(45) Date of Patent: Jul. 31, 2001

(54) TONER PROCESSES

(75) Inventors: Michael A. Hopper, Toronto; Raj D. Patel, Oakville, both of (CA)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/645,704

(22) Filed: Aug. 24, 2000

(51) Int. Cl.[7] ..... G03G 9/087
(52) U.S. Cl. ..... 430/137.14
(58) Field of Search ..... 430/137, 106, 430/109

(56) References Cited

U.S. PATENT DOCUMENTS

| | | | |
|---|---|---|---|
| 5,278,020 | 1/1994 | Grushkin et al. | 430/137 |
| 5,290,654 | 3/1994 | Sacripante et al. | 430/137 |
| 5,308,734 | 5/1994 | Sacripante et al. | 430/137 |
| 5,344,738 | 9/1994 | Kmiecik-Lawrynowicz et al. | 430/137 |
| 5,346,797 | 9/1994 | Kmiecik-Lawrynowicz et al. | 430/137 |
| 5,348,832 | 9/1994 | Sacripante et al. | 430/109 |
| 5,364,729 | 11/1994 | Kmiecik-Lawrynowicz et al. | 430/137 |
| 5,366,841 | 11/1994 | Patel et al. | 430/137 |
| 5,370,963 | 12/1994 | Patel et al. | 430/137 |
| 5,403,693 | 4/1995 | Patel et al. | 430/137 |
| 5,405,728 | 4/1995 | Hopper et al. | 430/137 |
| 5,418,108 | 5/1995 | Kmiecik-Lawrynowicz et al. | 430/137 |
| 5,482,812 | 1/1996 | Hopper et al. | 430/137 |
| 5,496,676 | 3/1996 | Croucher et al. | 430/137 |
| 5,501,935 | 3/1996 | Patel et al. | 430/137 |
| 5,527,658 | 6/1996 | Hopper et al. | 430/137 |
| 5,585,215 | 12/1996 | Ong et al. | 430/107 |
| 5,622,806 | 4/1997 | Veregin et al. | 430/137 |
| 5,650,255 | 7/1997 | Ng et al. | 430/137 |
| 5,650,256 | 7/1997 | Veregin et al. | 430/137 |
| 5,922,501 | 7/1999 | Cheng et al. | 430/137 |
| 5,945,245 | 8/1999 | Mychajlowskij et al. | 430/137 |
| 5,994,020 | 11/1999 | Patel et al. | 430/137 |
| 6,120,967 * | 9/2000 | Hopper et al. | 430/137 |
| 6,132,924 * | 10/2000 | Patel et al. | 430/137 |

* cited by examiner

*Primary Examiner*—John Goodrow
(74) *Attorney, Agent, or Firm*—E. O. Palazzo

(57) ABSTRACT

A toner process comprising mixing a functionalized wax with a colorant and a resin latex emulsion; adding an inorganic cationic coagulant; heating below the latex resin Tg; adjusting the pH to basic; and heating above the latex resin Tg.

30 Claims, No Drawings

TONER PROCESSES

BACKGROUND

This invention relates to toner and wax processes, and more specifically to the preparation of a surfactant free colorant, such as a pigment dispersion, wherein the colorant is melt blended into a wax that has been functionalized by the incorporation of from about 150 to about 600 of ionic groups such as carboxylic acid, sulfonate or phosphate groups resulting in an anionic functionality and an amino or amide groups with respect to cationic functionality to for example, allow the wax to be dispersable into a particulate aqueous dispersion when heated above room temperature in water at a pH value in the range of from about 2 to about 11 pH, wherein the resulting submicron particle size diameter is for example, in the range of about 80 to about 300 nanometers and wherein the colorant/wax particles are aggregated with a surfactant free latex containing submicron resin particles to provide toner compositions. More specifically, the present invention relates to a surfactant free chemical toner process wherein the process comprises (i) the preparation of an latex emulsion comprised of about 20 to about 50 weight percent of submicron resin particles in a diameter size range of, for example, from about 100 to about 300 nanometers suspended in an aqueous phase, such as water present, for example, in an amount of from about 80 to about 50 percent by weight, wherein the total amount of resin and water is about 100 percent and wherein the latex emulsion is surfactant free, (ii) preparing a wax which is functionalized with either anionic or cationic groups; (iii) melt blending this wax with a colorant to provide a colorant/wax mixture which is capable of being readily dispersable in warm water, for example from about 30 to about 50° C., at a suitable pH to provide a dispersion of submicron particles in the size range of about 50 to about 300 nanometers followed by aggregation and coalescence with the latex emulsion of (i) to provide a toner composition. The wax of (ii) utilized primarily to stabilize the colorant, such as pigment particles is for example, a polypropylene maleic anhydride with a saponification number of between about 42 and about 46, and which wax is capable of self dispersing in warm water, for example from about 30 to about 90° C., providing a submicron size dispersion. The resulting dispersion contains submicron wax particles suspended in water and wherein the wax possesses a diameter size of for example, in the range of about 80 to about 300 nanometers, wherein the dispersion comprises about 35 percent colorant, about 15 percent functionalized wax and about 50 percent water. More specifically, with the processes of the present invention an inorganic cationic metal salt can be selected as a coagulant to facilitate aggregation of the resin particles of the emulsion latex and submicron colorant particles stabilized by the functionalized wax by providing a coating or a shell on the colorant particles. With further respect to the processes of the present invention, there can be accomplished the staged increasing of the temperature during the coalescence wherein two or more heating temperatures are conducted to achieve the final coalescence to for example, retain the toner particle size distribution, followed by staged changing of the pH of the aggregate mixture wherein the pH is lowered in two or more sequences to, for example, provide toner processes which are surfactant free.

PRIOR ART

In forming toner compositions for use with reprographic or xerographic print devices, emulsion aggregation processes are known. For example, emulsion/aggregation/coalescing processes for the preparation of toners are illustrated in a number of Xerox Corporation patents, the disclosures of which are totally incorporated herein by reference, such as U.S. Pat. Nos. 5,290,654, 5,278,020, 5,308,734, 5,370,963, 5,344,738, 5,403,693, 5,418,108, 5,364,729, and 5,346,797. Also of interest may be U.S. Pat. Nos. 5,348,832, 5,405,728, 5,366,841, 5,496,676, 5,527,658, 5,585,215, 5,650,255, 5,650,256 and 5,501,935.

In addition, the following U.S. patents the disclosures of which are incorporated herein by reference in their entireties relate to processes for forming toner compositions. U.S. Pat. No. 5,922,501 discloses a process for the preparation of toner by blending an aqueous colorant dispersion and a latex resin emulsion, and which latex resin is generated from a dimeric acrylic acid, an oligomer acrylic acid, or mixtures thereof and a monomer; heating the resulting mixture at a temperature about equal, or below about the glass transition temperature (Tg) of the latex resin to form aggregates; heating the resulting aggregates at a temperature about equal to, or above about the Tg of the latex resin to effect coalescence and fusing of the aggregates; and optionally isolating the toner product, washing, and drying.

U.S. Pat. No. 5,945,245 illustrates a surfactant free process for the preparation of toner comprising heating a mixture of an emulsion latex, a colorant, and certain complexing agents.

U.S. Pat. No. 5,403,693 illustrates a process for the preparation of toner compositions with controlled particle size comprising: (i) preparing a pigment dispersion in water, which dispersion is comprised of a pigment, an ionic surfactant in amounts of from about 0.5 to about 10 percent by weight of water, and an optional charge control agent; (ii) shearing the pigment dispersion with a latex mixture comprised of a counterionic surfactant with a charge polarity of opposite sign to that of the ionic surfactant, a nonionic surfactant, and resin particles, thereby causing a flocculation or heterocoagulation of the formed particles of pigment, resin, and charge control agent; (iii) stirring the resulting sheared viscous mixture of (ii) at from about 300 to about 1,000 revolutions per minute to form electrostatically bound substantially stable toner size aggregates with a narrow particle size distribution; (iv) reducing the stirring speed in (iii) to from about 100 to about 600 revolutions per minute, and subsequently adding further anionic or nonionic surfactant in the amount range of from about 0.1 to about 10 percent by weight of water to control, prevent, or minimize further growth or enlargement of the particles in the coalescence (iii); and (v) heating and coalescing from about 5° C. to 50° C. about above the resin glass transition temperature, Tg, which resin Tg is from between about 45° C. to about 90° C. and preferably from between about 50° C. and about 80° C. the statically bound aggregated particles to form a toner composition comprised of resin, pigment and optional charge control agent.

U.S. Pat. No. 5,482,812 illustrates a process for the preparation of toner compositions or toner particles comprising: (i) providing an aqueous pigment dispersion comprised of a pigment, an ionic surfactant, and optionally a charge control agent; (ii) providing a wax dispersion comprised of wax, a dispersant comprised of nonionic surfactant, ionic surfactant or mixtures thereof; (iii) shearing a mixture of the wax dispersion and the pigment dispersion with a latex or emulsion blend comprised of resin, a counterionic surfactant with a charge polarity of opposite sign to that of said ionic surfactant and a nonionic surfactant; (iv) heating the above sheared blend below about the glass transition temperature (Tg) of the resin to form electrostatically bound toner size aggregates with a narrow particle size distribution; (v) adding additional ionic surfactant to the aggregated suspension of (iv) to ensure that no, or minimal additional particle growth of the electrostatically bound toner size aggregates occurs on further increasing the temperature to coalesce the aggregates into toner particles (vi); (vi) heating the mixture of (v) with bound aggregates above about or at the Tg of the resin; and optionally (vii) separating the toner particles from the aqueous slurry by filtration and thereafter optionally washing.

U.S. Pat. No. 5,622,806 illustrates a process for the preparation of toner compositions with controlled particle size comprising: (i) preparing a pigment dispersion in water, which dispersion is comprised of a pigment, an ionic surfactant in amounts of from about 0.5 to about 10 percent by weight to water, and an optional charge control agent; (ii) shearing the pigment dispersion with a latex mixture comprised of a counterionic surfactant with a charge polarity of opposite sign to that of said ionic surfactant, a nonionic surfactant, and resin particles, thereby causing a flocculation or heterocoagulation of the formed particles of pigment, resin, and charge control agent; (iii) stirring the resulting sheared viscous mixture of (ii) at from about 300 to about 1,000 revolutions per minute to form electrostatically bound substantially stable toiler size aggregates with a narrow particle size distribution; (iv) reducing the stirring speed in (iii) to from about 100 to about 600 revolutions per minute, and subsequently adding further anionic or nonionic surfactant in the range of from about 0.1 to about 10 percent by weight of water to control, prevent, or minimize further growth or enlargement of the particles in the coalescence (v); (v) heating and coalescing from about 5° C. to about 50° C. above about the resin glass transition temperature, Tg, which resin Tg is from between about 45° C. to about 90° C., the statically bound aggregated particles to form the toner composition comprised of resin, pigment and optional charge control agent; (vi) washing the aggregated particles at a temperature of from about 15° C. to about 5° C. below the glass transition temperature of the resin, and subsequently filtering the aggregated particles until substantially all of the surfactant has been removed from the aggregated particles, followed by subsequent driving of the particles at a temperature of from about 15° C. to about 5° C. below the glass transition temperature of the resin; and (vii) subsequently adding to said toner product a first layer of a hydrophilic oxide, and a second layer of a hydrophobic oxide.

In U.S. Pat. No. 5,994,020, the disclosure of which is totally incorporated herein by reference, there is illustrated toner processes wherein functionalized waxes are selected.

SUMMARY OF THE INVENTION

It is an feature of the present invention to provide toner processes which utilize a surfactant free latex emulsion followed by the aggregation/coalescence thereof with an aqueous dispersion of colorant particles comprising submicron colorant particles which are stabilized by submicron wax particles to provide a toner composition and wherein submicron refers for example, to a diameter of about 0.005 to about 1 micron as measured by a disc centrifuge.

It is a further feature of the present invention to provide a toner process that can be rapidly conducted for example, in from about 4 to about 6 hours and wherein only minimum washing of the toner particles is needed, such as such as 1 to 2 washes and less, for example, from 2 to 4 hours of coalescence time compared to a number of the known toner surfactant processes wherein the coalescence times are higher, for example from 5 to 8 hours.

These and other features of the present invention are achieved for example, by avoiding the use of known commercial surfactants during the preparation of the latex emulsion and which emulsion is prepared by polymerizing monomers, by emulsion polymerization methods, in the presence of a water soluble initiator, (ii) followed by the aggregation and coalescence of the resulting latex containing resin particles with colorant/wax particles in the presence of an inorganic cationic coagulant to provide toner particles. The coalescence of the formed aggregates can for example, be conducted at staged pH changes for example, primarily to prevent or minimize an increase in diameter particle size of for example greater than about 0.5 micron, for example from about 0.5 to about 3, from aggregation to coalescence and minimize particle size distribution.

DETAILED DESCRIPTION OF EMBODIMENTS

Aspects of the present invention relate to a process for the preparation of toner comprising: (i) generating by emulsion polymerization in the presence of an initiator a resin latex emulsion; (ii) selecting a functionalized wax capable of dispersing or dissipating in water at a suitable pH in the range for example, of from about 2 to about 10; (iii) mixing the functionalized wax of (ii) with a colorant resulting in a wax/colorant blend, followed by dispersing the wax/colorant blend in water in either acid or basic pH conditions to provide a wax/colorant coated dispersion, and wherein the colorant is coated with the wax; (iiib) mixing the resin latex emulsion of (i) with the wax/colorant mixture of (iii) to provide a blend of resin, wax and colorant;

(iv) adding an inorganic cationic coagulant solution of a metal salt to the resin, wax and colorant blend of (iiib); (v) heating at a temperature of from about 5 to about 10 degrees Centigrade below the resin Tg of (i), to thereby form aggregates particles and which particles are at a pH of from about 2 to about 3.5; (vi) adjusting the pH of (v) to about 6.5 to about 9 by the addition of a base; (vii) heating at a temperature of from about 5° C. to about 50° C. above the Tg of the resin of (i), followed by a reduction of the pH to from about 2.5 to about 5 by the addition of an acid resulting in coalesced toner; (viii) optionally isolating the toner; a process for the preparation of a toner comprising: (i) generating by emulsion polymerization in the presence of a water soluble initiator, a latex emulsion, comprising submicron, for example, less than about 1 micron in diameter resin particles; (ii) selecting a functionalized wax containing an anionic or a cationic functionally, which is then dispersed in water in basic or acidic pH conditions to provide submicron wax particles in the size range of about 80 to about 200 nanometers; (iii) mixing (ii) and a colorant wherein there is formed a coating of wax (ii) on said colorant thereby providing a stable colorant/wax dispersion wherein from about 80 to about 95 percent of colorant is coated by the wax; (iv) blending the resin latex emulsion of (i) with the colorant/wax dispersion (iii), to form a resin latex, colorant and wax blend; (v) adding an aqueous inorganic cationic coagulant solution of a metal salt to the resin latex/colorant-wax blend (iv), while continuously subjecting the blend to high shear to induce a homogeneous resin/colorant/wax blend; (vi) heating the sheared gel of (v) at a temperature of from about 5° C. to about 10° C. below the resin (i) glass transition temperature while optionally continuously stirring to form aggregates particles of resin, coagulant and colorant; (vii) optionally retaining (vi) for a period of from about 1 to about 3 hours to primarily minimize growth of the aggregates and achieve a narrow GSD of from about 1.15 to about 1.24; (viii) optionally adding a further latex comprised of resin(i), wherein the addition of said latex enables the formation of a coating on the said aggregates of (vii); (ix) changing the pH of the aggregates of (viii) which is in the range of from about 2 to about 3.5 to a pH in the range of about 6.5 to about 9 by the addition of a base to thereby primarily stabilize the aggregate particles from further growth; (x) heating the aggregate particles of (ix) at a temperature of from about 5° C. to about 50° C. above the Tg of the resin (i), for period of from about 0.5 to about 1 hour, followed by a reduction of the pH from about 6.5 to about 9 to a pH of about 2.5 to about 5 with an acid to form coalesced particles of a toner composition of resin colorant and wax; and (xi) optionally separating and drying the toner; a process for the preparation of toner comprising (i) forming by emulsion polymerization in the presence of an initiator a resin latex dispersion of styrene/butylacrylate/methylacrylate/sodium styrene sulfonate resin particles in water and wherein the resin is submicron in the size range of about 50 to about 250 nanometers; (ii) selecting a functionalized wax containing either an anionic or a cationic functionally, which is then dispersed in water in basic or acidic pH conditions to provide submicron wax particles in the size range of about 80 to about 200 nanometers followed by mixing (ii) and a colorant wherein there is formed a coating of wax (ii) on said colorant thereby providing a stable colorant/wax dispersion wherein from about 80 to about 95 percent of colorant is coated by said wax; (iii) wherein the dispersion of (ii) is then utilized to stabilize the colorant particles resulting in a colorant dispersion; (iv) blending the resin latex dispersion with the colorant dispersion; (v) adding an aqueous inorganic cationic coagulant solution of a metal salt to the wax/colorant while optionally continuously subjecting the blend to high shear, to induce a homogeneous gel of the resin-pigment blend; (vi) heating the sheared gel at temperature of 5 to 10 degrees Centigrade below the resin glass transition temperature (Tg); (vii) optionally adding a further latex, followed by; (viii) changing the pH of the mixture of (vi) initially about 2 to about 3 to about 6.5 to about 9 with a base to stabilize the aggregate particles from further growth; (ix) heating the aggregate particles at temperatures of 5° C. to 50° C. above the Tg of the resin, for a period of 0.5 to 1 hour, followed by a reduction of the pH from the range of 6.5 to 9.0 to about 2.5 to 5.0 and preferably to 3 to 4.5 with an acid to form coalesced particles of a toner composition with a smooth surface; (x) optionally separating and drying the toner; a toner process comprising mixing a functionalized wax with a colorant and a resin latex emulsion; adding an inorganic cationic coagulant; heating below the latex resin Tg; adjusting the pH to basic; and heating above the latex resin Tg; a process for the preparation of a toner composition comprising (i) forming a first resin latex emulsion of a submicron resin particles in the absence of an ionic or a nonionic surfactant by emulsion polymerization; (ii) selecting a functionalized wax, wherein the wax is capable of self dispersing in water; (iii) melt blending the selected functionalized wax with a colorant such as a pigment to provide a colorant/wax blend; (iv) dispersing the colorant/wax blend in water in either an acidic pH when the functionalized groups are cationic and the pH is in the range of about 2 to about 6 or a basic pH when the functionalized group are anionic in nature and wherein the pH is in the range of about 8 to about 11, to provide submicron colorant/wax particles wherein the colorant particles are stabilized by the functionalized wax by providing a coating or a shell of wax thereover, and which coating is of a thickness of for example, from about 90 to about-150 nanometers; (v) blending the resin latex emulsion of (i) with the colorant/wax dispersion of (iv), to form a resin-colorant-wax blend where the resin is present in the amount range of about 85 percent to about 95 percent and the wax coated colorant is in the amount range of about 15 percent to about 5 percent; (vi) adding an aqueous coagulant solution to the resin/wax coated colorant blend, while continuously subjecting the blend to high shear for example in the range of about 2,000 to about 6,000 rpm, to generate a homogeneous mixture of the resin/colorant/wax blend; (vii) heating the resulting sheared resin/colorant/wax blend at temperature below the resin glass transition temperature (Tg) while continuously stirring to form aggregates; (viii) following a period of about 1 to about 3 hours of aggregation time to permit growth of the submicron latex/wax coated pigment blend to form stable aggregate particle size, (stabilization of aggregate particle size); (ix) optionally adding the resin latex emulsion of (i) to the mixture of the aggregate particles (x) and changing the pH of the mixture from about 2.4 to greater than about 6 and more specifically to about 6.5 to about 9 with the addition of a base to stabilize the aggregates wherein the increase in the pH assists in retaining the aggregate particle size and the particle size distribution thereof; (xi) heating the aggregate at a temperature of above the Tg (glass transition) of the resin, followed by a reduction of the pH from about 8 to about 2.5 to about 5.8 and preferably from about 8 to about 3 to about 5.5 by the addition of an acid to thereby form coalesced toner particles with a uniform smooth surface, almost spherical in morphology, as observed under an optical microscope wherein the advantages of such particles include their clean capability characteristics during image development, less amounts of toner surface additives usage dry blending, stable triboelectric charge in the developer housing, and improved mechanical interegrity of the toner particles in the developer housing; (xii) followed by separating the particles by for example, filtration, or centrifugation and drying the toner particles by, for example, freeze drying, fluid bed drying or spray drying; a process for the preparation of a toner composition comprising (i) forming a first resin latex emulsion of a submicron resin particles in the absence of ionic or a nonionic surfactant; (ii) selecting a functionalized wax wherein the wax is then dispersed in water at acidic or basic pH conditions depending on the functionality of the wax to provide a submicron wax dispersion, or a self dispersing wax; (iii) selecting a colorant, wherein the wax dispersion of (ii) is then used as a colorant dispersant thereby providing an about 80 to about 200 nm and preferably about 90 to about 150 nm thickness coating or a shell on the colorant by using grinding mills; (iv) blending the resin latex emulsion of (i) with the colorant-wax dispersion of (iii), to form a resin/colorant-wax blend; (v) adding an aqueous coagulant solution to the resin/colorant/wax blend, while continuously subjecting the blend to at high shear, for example at speeds of from about 2,000 to about 6,000 rpms to induce a homogeneous mixture of resin-colorant/wax/blend; (vi) heating the sheared gel at temperature below the resin glass transition temperature (Tg) while continuously stirring to form aggregates particles; (vii) following a period of from about 1 to about 3 hours of aggregation time to permit stabilization of the aggregated particle size; (viii) optionally adding the resin latex emulsion of (i) to the mixture of the aggregate particles (ix);changing the pH of the mixture from 2.4 to greater than about 6 and preferably in the range of about 6.5 to about 9 with a base to stabilize the formed toner size aggregates wherein the increase in the pH asserts in retaining the aggregate particle size and the particle size distribution; (x) heating the aggregate particles at temperatures above the Tg of the resin, followed by a reduction of the pH from 8 to 2.5 to 5.5 and preferably to about 3 to about 5 with an acid, thereby generating coalesced toner particles with a particle smooth surface, (xi) followed by separating the toner particles by either filtration or centrifugation or other means such as press filters and drying the particles by, for example, freeze drying, fluid bed drying or spray drying; (i) forming a resin latex emulsion of resin particles of, for example, styrene-butylacrylate-sodium styrene sulfonate and which formation is accomplished in the absence of surfactants and which formation is accomplished by an emulsion polymerization, wherein the monomers utilized are polymerizable in the presence of a water soluble initiator; (ii) selecting a functionalized wax, wherein the wax is capable of self dispersing in water in basic or acidic pH conditions, wherein for example, the wax is a polypropylene functionalized by carboxylic acid which is solubilized in basic pH conditions, a polypropylene wax functionalized by a sulfonated or amide groups which are solubilized in acidic pH conditions; (iii) melt blending the selected functionalized wax with a colorant to provide a colorant/wax blend; (iv) dispersing the colorant/wax blend in water at acidic or a basic pH conditions to provide submicron colorant/wax particles wherein the colorant particles are stabilized by functionalized wax by providing a coating or a shell (v) thereover; blending the resin latex emulsion of the colorant/wax dispersion of (iv), to form a resin-colorant-wax blend; (vi) adding an aqueous inorganic coagulant solution such as poly aluminum chloride (PAC) to the resin-pigment-wax blend, while continuously subjecting the blend to high shear, to induce a homogeneous mixture of a resin-colorant-wax blend; (vii) heating at temperature of 5 to 10° C. below the resin glass transition temperature (Tg) where the resin Tg is about 53° C., while continuously stirring to form aggregates particles; (viii) following a period of aggregation time to permit the stabilization of the aggregate particle size; (ix) optionally adding a the above latex prepared in (i) or a latex comprising a different composition and/or molecular properties such as molecular ($M_w$), ($M_n$), and Tg of the resin, to the mixture of the aggregate particles; (x) changing the pH of the mixture which is 2 to 3 to greater than 6 and preferably to 6.5 to 9 with a base initially; (xi) heating the aggregate particles at temperatures of 5 to 60° C. above the Tg of the resin which is about 53° C., followed by a reduction of the pH to about 2.5 to 5.5 and preferably to 3 to 5 with an acid to form coalesced particles of a toner composition with a smooth surface, almost spherical in morphology; (xii) followed by separating the particles by either filtration; centrifugation or other means and drying the particles by either freeze drying, fluid bed drying or spray drying; and a process for the preparation of a toner composition comprising (i) forming a first resin latex emulsion of resin particles comprising for example, styrene-butylacrylate-sodium styrene sulfonate in the absence of any ionic or a nonionic surfactant by an emulsion polymerization wherein the monomers utilized are polymerizable in the presence of a water soluble initiator; (ii) selecting a functionalized wax, wherein the wax is dispersable in water in either basic or acidic pH conditions for example, the wax can be a polypropylene wax functionalized by carboxylic acid dispersed or solubilized at a basic pH, while a polypropylene wax functionalized by sulfonated groups can be dispersed or solubilized in acidic pH conditions; (iii) wherein the wax dispersion of (ii) is then selected as a colorant dispersant thereby providing a coating or a shell thereon the colorant; (iv) blending the resin latex emulsion of (I) with the colorant-wax dispersion of (iii), to form a resin-colorant-wax blend; (v) adding an aqueous inorganic coagulant solution such as poly aluminum chloride (PAC) to the resin-colorant-wax blend, while continuously subjecting the blend to high shear, to induce a homogeneous mixture of the resin-colorant-wax blend; (vi) heating the sheared gel at temperature of 5° C. to 10° C. below the resin glass transition temperature (Tg) while continuously stirring to form aggregates particles; (vii) permitting a period of aggregation time to permit stabilization of the aggregate particle size; (viii) optionally adding the above latex prepared in (i) to provide a core/shell (ix) changing the pH of the mixture initially 2 to 3 to greater than 6 and preferably to 6.5 to 9 with a base; (x) heating the aggregate particles at temperatures of 5 to 60° C. above the Tg of the resin, followed by a reduction of the pH to about 2.5 to 5.5 and preferably to about 3 to about 5 with an acid to form coalesced particles of a toner composition with a smooth surface; (xi) followed by separating the particles and drying the particles by freeze drying, fluid bed drying or spray drying; and wherein minimum washing is needed, since there are no surfactants utilized in the preparation and only salts such as sodium chloride or other ions resulting from the aggregation/coalescence process are present and can be removed during isolation and washing; and the preparation of a latex by emulsion polymerization wherein the resulting resin particles selected are styrene acrylates, styrene butadiene, styrene isoprenes, styrene methacrylate and wherein the resin particle are stabilized by organic monomer such as sodium styrene sulfonate or other water soluble polymers.

Illustrative examples of latex resin particles of (i) are selected for example, from the group consisting of poly (styrene-butylacrylate), poly(styrene-butadiene), poly(para-methyl styrenebutadiene), poly(meta-methyl styrene-butadiene), poly(alpha-methyl styrene-butadiene), poly (methylmethacrylate-butadiene), poly(ethylmethacrylate-butadiene), poly(propylmethacrylate-butadiene), poly (butylmethacrylate-butadiene), poly(methylacrylate-butadiene), poly(ethylacrylate-butadiene), poly (propylacrylate-butadiene), poly(butylacrylate-butadiene), poly(styrene-isoprene), poly(para-methyl styrene-isoprene), poly(meta-methyl styrene-isoprene), poly(alpha-methylstyrene-isoprene), poly(methylmethacrylate-isoprene), poly(ethylmethacrylate-isoprene), poly (propylmethacrylate-isoprene), poly(butylmethacrylate-isoprene), poly(methylacrylate-isoprene), poly (ethylacrylate-isoprene), poly(propylacrylate-isoprene), and poly(butylacrylate-isoprene); and terpolymers such as poly (styrene-butadiene-acrylic acid), poly(styrene-butadiene-methacrylic acid), PLIOTONE available from Goodyear, polyethylene-terephthalate, polypropylene-terephthalate, polybutylene-terephthalate, polypentylene-terephthalate, polyhexalene-terephthalate, polyheptadene-terephthalate, polyoctalene-terephthalate, all containing sodium styrene sulfonate in the range of 0.5 pph to 5 pph, need full chemical names for these POLYLITE (Reichhold Chemical Inc.), PLASTHALL (Rohm & Haas), CYGAL (American Cyanamide), ARMCO (Armco Composites), ARPOL (Ashland Chemical), CELANEX (Celanese Eng), RYNITE (DuPont), and STYPOL.

Example of waxes that can be selected are polyethylene, polypropylene functionalized waxes, amines, and amides for example, Microspersion 19—solubilized at a pH of 8.5 to 11 where the amide is hydrolyzed rendering the wax dispersable; polyethylene/PTFE/Amide, Microspersion 411;

microspersion waxes available from Micro powder and generally solubilized under basic pH conditions; a polyethylene/amide available from Micro powder Inc., stearamide; methylol stearamide, ethylenebis stearamide, steric acid available from Cytech Products, Inc., modified polyethylene, polypropylene containing maleic anahydride resulting in a copolymer of alpha olefin/maleic anhydride such as CERAMER available from Petrolite; modified polyethylene, polypropylene with carboxylic acids groups such as UNICID available from Petrolite; these modified waxes usually possess acid numbers in the range of about 30 to about 250; Aqua Polysilk 19, Polysilk 14, all polethylene/PTFE/amide functionalized waxes available from Micro Powders Inc., mixed fluroniated, amide waxes for example, Microspersion 19 available from Micro Powders Inc.; imides, esters, quaternary amines, carboxylic acids or acrylic polymer emulsion for example.

The latex resin particles of (i) are present in various effective amounts, such as from about 70 weight percent to about 98 weight and preferably between about 80 and about 92 percent of the toner, and can be of small average particle size such as from about 0.01 micron to about 1 micron in average volume diameter as measured by the Brookhaven nanosize particle analyzer. Other effective amounts of resin can be selected in embodiments.

The latex resin particles of (i) selected for the process of the present invention are preferably prepared by, for example, emulsion polymerization techniques, including semi-continuous emulsion polymerization methods, and the monomers utilized in such processes can be for example, styrene, acrylates, methacrylates, butadiene, isoprene, all containing sodium styrene sulfonate, and optionally acid or basic olefinic monomers such as acrylic acid, methacrylic acid, acrylamide, methacrylamide, quaternary ammonium halide of dialkyl or trialkyl acrylamides or methacrylamide, vinylpyridine, vinylpyrrolidone, vinyl-N-methylpyridinium chloride and the like. The presence of acid or basic groups in the monomer, or polymer resin is optional and such groups can be present in various amounts of from about 0.1 to about 10 percent by weight of the polymer resin. Chain transfer agents such as dodecanethiol, carbon tetrabromide, and the like, can also be selected when preparing resin particles by emulsion polymerization.

Suitable water soluble initiators include but are not limited to ammonium persulfate, potassiun persulfate, sodium persulfate, ammonium persulfite, potassium persulfite, sodium persulfite, ammonium bisulfate, potassium bisulfate, sodium bisulfate, 1,1'-azobis(1-methybutyronitrile-3-sodium sulfonate, and 4,4'-azobis(4cyanovaleric acid. Preferably the initiator is a persulfate initiator such as ammonium persulfate, potassium persulfate, sodium persulfate and the like. The initiator is generally added as part of an initiator solution in water. The amount of initiator used to form the latex polymer is for example, from about 0.1 to 10 weight percent of the monomer to be polymerized.

The resin latex dispersion (ii) comprised for example, of styrene-butylacrylate-sodium styrene sulfonate, methacrylic acid in the ratio of 81:17:0.5 1.5, styrene-isoprene-sodium styrene sulfonate methacrylic acid, styrene-n butylacrylate-potassium-3-sulfopropylacrylate methacrylic acid, styrene-isoprene-potassium-3-sulfopropylacrylate methacrylic acid, styrene-n butylacrylate-potassium-3-sulfopropymethacrylate methacrylic acid, styrene-isoprene-potassium-3-sulfopropylmethacrylate methacrylic acid, sodium styrene sulfonate, stryrene-isobutylmethacrylate-sodium styrene sulfonate methacrylic acid, styrene-isobutylmethacrylate-potassium-3-sulfopropylacrylate methacrylic acid, and the like, and water. The solids content may vary from for example, about 10 to about 60 weight percent of resin and about 90 to about 40 weight percent water.

The colorant dispersion preferably comprises submicron colorant particles in the diameter size range of about 0.08 to about 0.2 micron which are stabilized for example, by submicron wax particle of for example, polypropylene maleic anhydride with an acid number in the range of about 150 to about 600 and a sapnofication number in the range of about 40 to about 300, which waxes are for example, in the size diameter range of about 0.05 to about 0.15 microns and which wax acts as a dispersant for the colorant particles. Other polymeric waxes that can be employed are those with functionalized groups such as carboxylic acids, sulfonates, phosphates, and the like, and more specifically maleic anhydride which waxes can be dispersed in water in either acidic or basic conditions and preferably in a base especially at a pH of 10 for example, wherein the polypropylene maleic anhydride and other waxes can be hydrolyzed into an acid allowing it to be dispersable in water into submicron particle with the assistance of heat.

In some instances, colorants are available in the wet cake or concentrated form containing water, and can be easily dispersed utilizing a homogenizer or simply by stirring. Also, colorants are available in a dry form, whereby a dispersion in water is effected by microfluidizing using, for example, a M-110 microfluidizer, an ultimizer and passing the dispersion from 1 to 10 times through a suitable chamber, by sonication, such as using a Branson 700 sonicator, or a homogenizer with the addition of dispersing agents such as resin emulsion particles of styrene-butylacrylate-sodium styrene sulfonate and other water soluble polymers. Colorant dispersions can include melt mixing or flushing of the colorant with a functionalized wax followed by dispersing in water in either basic or acidic pH conditions to provide a stable sub micron pigment particles coated by a functionalized wax dispersion.

Various known colorants such as pigments, dyes or mixtures thereof that are selected and can be present in the final toner in an effective amount of, for example, from about 1 to about 25 percent by weight of the toner, and preferably in an amount of from about 1 to about 15 weight percent include known cyan, magenta, yellow, red, green, and blue pigments. Specific examples of pigments include phthalocyanine HELIOGEN BLUE L6900, D6840, D7080, D7020, PYLAM OIL BLUE, PYLAM OIL YELLOW, PIGMENT BLUE 1, available from Paul Uhlich & Company, Inc Pigment Blue 15.3, Pigment Red 81.3, Pigment 122, Pigment Red 238, Pigment Yellow 14, Pigment Yellow 17, Pigment Yellow 74, Pigment Green 7, Pigment Orange 16 available from Sun Chemicals PIGMENT VIOLET 1, PIGMENT RED 48, LEMON CHROME YELLOW DCC 1026, E.D. TOLUIDINE RED and BON RED C available from Dominion Color Corporation, Ltd., Toronto, Ontario, NOVAperm YELLOW FGL, HOSTAPERM PINK E, Pigment Yellow 180 from Clariant, and CINQUASIA MAGENTA available from E. I. DuPont de Nemours & Company, and the like. Examples of magentas that may be selected include, for example, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyans that may be used include copper tetra(octadecyl sulfonamido) phthalocyanine, x-copper phthalocyanine pigment listed in the Color Index as CI 74160, CI Pigment Blue, and Anthrathrene Blue, identified in the Color Index as CI 69810, Special Blue X2137, and the like; while illustrative examples of yellows are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL. The colorants selected are present in various effective amounts, such as from about 1 weight percent to about 65 weight and preferably from about 2 to about 12 percent of the toner.

Emulsion aggregation processes for generating chemical toners in accordance with aspects of the present invention utilize an ionic coagulant in an amount of for example, from about 40 to about 80 and more specifically from about 50 to about 70 percent based on the amount of the ionic coagulant with an opposite polarity preferably a positive polarity compared to the ionic charge of the latex (a counterionic coagulant), typically a cationic coagulant to ensure that the latex containing the anionic charge is aggregated into toner particles. Also the coagulant is preferably present to prevent the appearance of fines in the final slurry, fines being small sized particles of less than about 1 micron in average volume diameter, and which fines can adversely affect toner yield.

The coagulants may be comprised of organic components, inorganic entities or mixtures thereof and which preferably possess an opposite polarity to the ionic charge of the submicron resin latex particles suspended in water to provide a dispersion. For example, in embodiments of the present invention the ionic charge of the resin latex dispersion is anionic in nature due the water soluble initiator such as a persulfate and or the monomers used for the preparation of the latex, such as sodium styrene sulfonate, or methacrylic acid and thus the counterionic coagulant is an inorganic cationic coagulant of a metal salt such as polyaluminium chloride, or polyaluminium sulfo silicate and optionally a mono or divalent, for example sodium chloride, or magnesium chloride salt and other metal sulfates, phosphates, or chlorides.

Examples of specific coagulants that can act as aggregation agents that can be selected for the processes of the present invention are for example, aluminum sulfate, magnesium sulfate, zinc sulfate, potassium aluminum sulfate, calcium acetate, calcium chloride, calcium nitrate, zinc acetate, zinc nitrate, aluminum chloride. The coagulant is preferably contained in an aqueous medium in an amount of from, for example, 0.05 to 10 weight percent by weight and preferably in the range of about 0.075 to about 2 weight percent by weight of toner. The coagulant may also contain minor amounts of other components such as for example, nitric acid.

The coagulant is preferably added slowly over for example, a period of 0.5 minutes to 30 minutes and more specifically over a period of 1 to 10 minutes into the resin/wax coated colorant blend while continuously subjecting the blend to high shear, for example by stirring with a blade at about 3,000 to 10,000 rpm, and preferably about 5,000 rpm, for about 1 to about 120 minutes. A high shearing device, for example an intense homogenization device such as the in-line IKA SD-41, may be used to ensure that the blend is homogeneous and uniformly dispersed. The resin/colorant/wax can comprise for example, about 85 weight percent resin, 10 weight percent colorant, 5 weight percent functionalized wax to about 94 weight percent resin, 1 weight percent wax, and 5 weight percent colorant.

Following homogenization, aggregation of the homogenized composition is effected by heating the composition to a temperature below the glass transition temperature (Tg) of the resin of the latex while agitating the composition. The temperature of the heating is from for example, about 5° C. to 10° C. below the Tg of the resin. The agitation preferably comprises continuously stirring the mixture using a mechanical stirrer at between, for example, 200 to 800 rpm.

The aggregation is conducted for a period of time until the aggregate particle size is stabilized which may be for from for example, about 10 minutes to about 6 hours. Optionally there can be added a latex in (i) comprising for example, styrene/butylacrylate/acrylic acid/sodium styrene sulfonate in the ratio of 87:17:1.5:0.5, and the like, to the aggregates formed wherein the latex is adsorbed on the aggregate surface followed by allowing the aggregates to stabilize in particle size over a period for example, of from about 10 minutes to about 60 minutes.

The particles are then coalesced by first changing the pH of the aggregate composition from a pH of about 2.5 to a pH greater than about 5.5, and more specifically to about 6 to about 8, with the addition of a base to stabilize the aggregates from further growth, or minimize further growth followed by heating at a temperature above the Tg of the resin to be present in the toner particles. Preferably, the heating for coalescing is conducted at a temperature of from 5° C. to 40° C., and preferably 10° C. to 30° C., above the Tg of the resin for about 30 minutes to about 5 hours, wherein the resin Tg is from about 45° C. to about 56° C.

More specifically prior to the coalescence the pH of the aggregate composition which is for example in the range of 2 to 3 is changed to a pH range of for example about 6 to 8 with any suitable pH increasing agent, such as for example an alkaline metal hydroxide, like sodium hydroxide. The increase in the pH stabilizes the aggregates particles and prevents or minimizes particle size growth size distribution during further heating for example, raising the temperature 5° C. to 40° C. above the resin Tg. After about 15 to about 60 minutes at the coalescence temperature, the pH is then gradually decreased to about 3 to about 5, wherein the reduction in pH permits the colaescence or the fusion process. The preferred pH reducing agents include for example nitric acid, citric acid, sulfuric acid, hydrochloric acid, and the like, and which agent can be selected in various amounts, such as about 1 to about 15 weight percent.

The toner particles obtained with the processes of the invention may also include known charge additives in effective amounts of for example, from 0.1 to 5 weight percent such as alkyl pyridinium halides, bisulfates, the charge control additives of U.S. Pat. Nos. 3,944,493, 4,007,293, 4,079,014, 4,394,430 and 4,560,635, the disclosures of which are totally incorporated herein by reference, and the like. Surface additives that can be added to the toner compositions after washing or drying include, for example, metal salts, metal salts of fatty acids, colloidal silicas, metal oxides, mixtures thereof and the like, which additives are usually present in an amount of from about 0.1 to about 2 weight percent, reference U.S. Pat. Nos. 3,590,000, 3,720,617, 3,655,374 and 3,983,045, the disclosures of which are totally incorporated herein by reference. Preferred additives include zinc stearate and AEROSIL R972® available from Degussa each in amounts of from 0.1 to 2 percent which can be added during the aggregation process or blended into the formed toner product.

Developer compositions can be prepared by mixing the toners obtained with the process of the present invention with known carrier particles, including coated carriers, such as steel, ferrites, and the like, reference U.S. Pat. Nos. 4,937,166 and 4,935,326, the disclosures of which are totally incorporated herein by reference, for example from about 2 percent toner concentration to about 8 percent toner concentration.

With the process of the invention, toner particles of acceptable size and narrow dispersity are obtained in a rapid manner. The toner particles preferably have an average volume diameter of from about 0.5 to about 25, and preferably from about 1 to about 12 microns, and a narrow GSD characteristic of from about 1.05 to about 1.25, and preferably of from about 1.15 to about 1.25 as measured by a Coulter Counter. The toner particles also have an excellent shape factor, for example of 120 or less, wherein the shape factor is for example a measure of smoothness and roundness, where a shape factor of 100 is considered perfectly spherical and smooth, while a shape factor of 140 is considered to be rough in surface morphology and the shape is like a potato and is usually measured by a microscope indicating a very spherical shape of toner is obtained. The resulting toners can be selected for known electrophotographic imaging and printing processes, including color processes, and lithography.

The following Examples illustrate the embodiments and advantages of the present invention. Parts and percentages are by weight unless otherwise indicated.

EXAMPLES (a) Latex Preparation

A latex was prepared with 40 weight percent monomer loading, and a weight ratio of 81/17 weight percent St/BA (styrene/butylacrylate) monomer and 1.5 weight percent acrylic acid monomer. The latex preparation was performed in the following manner. The organic phase was comprised of 523 grams of styrene, 109.8 grams of butyl acrylate, 9.7 grams of acrylic acid to which 7.9 grams (1.25 weight percent by weight of monomer) of dodecanethiol-DDT (a chain transfer agent) was added and mixed. Separately there was generated an aqueous phase comprised of 950 grams of deionized water to which 7.9 grams of ammonium persulfate (initiator) to which 3.2 grams of 4-styrenesulfonic acid, sodium salt was added and well mixed (mixture A). The aqueous phase was then charged into a 2L buchi reactor and heated to 70° C. with stirring, and the organic phase of mixture A was then slowly added to the aqueous phase over a period of 3 hours. The resulting emulsified phase was then held at a temperature of 70° C. for a period of 2 hours more to conduct the emulsion polymerization. The reactor was then cooled down to room temperature, about 25° C. throughout, and the physical properties of the latex comprised of 40 percent styrene-butylacrylate-acrylic acid-sodium styrene sulfonate resin particles in 60 percent water were measured resulting in a particle size of 150 nanaometers, with a resin $M_w$ of 30K (30,000) and a Tg of 53.1° C. The latex resin was comprised of 81 parts styrene, 17 parts butylacrylate, 1.5 parts of acrylic acid, and 0.5 parts of sodium styrene sulfonate (b) Melt Blending Pigment & Functionalized Wax 60 Grams of polypropylene maleic anhydride (A-C 1211) supplied by Allied Signal Specialty Chemicals was melt mixed with 140 grams of P.B. 15.3 pigment available from Sun Chemicals. The resulting pigment-wax blend comprising 70 weight percent pigment and 30 weight percent wax was then crushed into granules with a coffee grinder. The resulting granules were then dispersed into 200 gms (grams) of 75° C. heated water having a pH of 10. The mixture was allowed to stir until the granules were all dispersed resulting in submicron, in the size range of 80 to 300 nanometers, of stabilized pigment particles where the wax forms a coating or a shell on the pigment particles of about 50 to about 150 nanometers in thickness. The dispersion comprised 35 weight percent pigment, 15 weight percent wax and 50 weight percent water (Dispersion # 1).

(c) Preparation of Wax Dispersion/pigment Dispersion (Dispersion #2)

60 Grams of polypropylene maleic anhydride (A-C 1211) supplied by Allied Signal Specialty Chemicals was dispersed in 200 grams of 75° C. heated water at a pH of 10. The mixture was stirred until all the wax was dispersed resulting in sub micron wax particles in the diameter size range of 80 to 150 nanometers. This wax dispersion was then added to 140 grams of Pigment Blue 15.3 and ground in a media mill until the pigment was broken down into submicron particles in the presence of the wax dispersion resulting in a pigment-wax dispersion in the size range for the solids of 120 to 250 nanometers. The pigment dispersion prepared comprised 35 percent pigment, 15 percent of the wax as a coating on the pigment and 50 percent water. The pigment dispersion obtained did not settle out over a period of 45 days indicating a stable pigment dispersion.

Other Pigment Dispersion Preparations

Yellow Dispersion

Similarly, a yellow 14 pigment dispersion was prepared by both dispersion methods (b) and (c) above where the dispersion comprised 35 weight percent Yellow 14 pigment, 15 weight percent polypropylene maleic wax, and 40 weight percent water.

Red Dispersion

Similarly a Red 81.3 pigment dispersion was prepared both dispersion methods (b) and (c) above where the dispersion comprised 35 weight percent PR 81.3 pigment, 15 weight percent polypropylene maleic wax and 40 weight percent water.

Toner Preparation

Example I

Cyan Toner

To 310 gram of the above latex of 40 percent solids comprising styrene/butylacrylate/sodium styrene sulfonate submicron resin particles of 190 nanometers in size diameter suspended in an 60 percent aqueous (water) media was simultaneously added with 100 grams of a dilute pigment dispersion comprising 20 grams of P.B. 15.3 pigment stabilized by polypropylene maleic anhydride (PMA) wax (Dispersion #1) submicron particles (35 weight percent pigment and 15 weight percent of PMA wax particles) and 80 grams of water, to 500 grams of water, while being polytroned at 3,000 RPM. 15 Grams of an aqueous acidified inorganic cationic coagulant of aluminum sulfate solution containing 3.0 grams of aluminum sulfate, 11 grams of water and 1.0 gram of 0.5 weight percent nitric acid, pH=2.5 was added to the above latex-pigment mixture and polytroned for 3 minutes. The mixture was then transferred into a reaction kettle and heated to 48° C. for a period of 150 minutes where the particle size as measured on a Coulter Counter was 5.5 microns with a GSD of 1.19. The pH of the slurry was then adjusted from a pH of 2.5 to a pH of 7.5 with the addition of 4 weight percent aqueous NaOH solution. The temperature of the reaction kettle was raised to 85° C. and held there for 30 minutes. The aggregate, particle size measured was 5.6 microns with a GSD of 1.20. The temperature of the reactor was then further raised to 90° C. and held there for 30 minutes resulting in a particle size of 5.6 microns and a GSD of 1.19. The pH of the reaction mixture was then slowly reduced down to 6 with 2.5 weight percent dilute nitric acid. After an additional 30 minutes the pH was further reduced to 5. An additional 80 minutes at 90° C. resulted in smooth toner particles and the toner shape factor was considered to be 120 as measured by a scanning electron miscroscope, where a shape factor of 100 is considered to be perfectly spherical. The toner particle size after cooling the reactor contents was found to be 5.9 microns with a GSD of 1.21. The toner was comprised of 92.5 percent of resin (i), 2.2 percent of the above PMA wax (ii) and 5.2 percent of P.B. 15.3 pigment.

Example II

Yellow Toner

To 310 grams of the above latex of 40 percent solids comprising styrene/butylacrylate/sodium styrene sulfonate submicron resin particles of 190 nanometers in diameter size suspended in an 60 percent aqueous (water) media was simultaneously added with 100 grams of a dilute pigment dispersion comprising 35 grams of Yellow 14 pigment stabilized by polypropylene maleic anhydride (PMA) wax (Dispersion #1) submicron particles (35 weight percent pigment and 15 weight percent PMA wax particles) and 50 grams of water, to 500 grams of water, while being polytroned at 3,000 RPM. 15 Grams of aqueous an acidified inorganic cationic coagulant of aluminum sulfate solution containing 3.0 grams of aluminum sulfate, 11 grams of water and 1 gram of 0.5 weight percent nitric acid, pH=2.5 was added to the above latex-pigment mixture and polytroned for 3 minutes. The mixture was then transferred into a reaction kettle and heated to 48° C. for a period of 160 minutes where the particle size as measured on a Coulter Counter was 5.7 microns with a GSD of 1.20. The pH of the slurry was then adjusted from a pH of 2.5 to a pH of 7.5 with the addition of 4 weight percent aqueous NaOH solution. The temperature of the reaction kettle was raised to 85° C. and held there for 30 minutes. The aggregate, particle size measured was 5.8 microns with a GSD of 1.20. The temperature of the reactor was then further raised to 90° C. and held there for 30 minutes resulting in a particle size of 5.8 microns and a GSD of 1.20. The pH of the reaction mixture was then slowly reduced down to 6 with 2.5 weight percent dilute nitric acid. After an additional 30 minutes the pH was further reduced to 5. An additional 100 minutes at 90° C. resulted in smooth toner particles and the toner shape factor was considered to be 120 as measured by a scanning electron miscroscope, where a shape factor of 100 is considered to be perfectly spherical. The toner particle size after cooling the reactor content was found to be 5.9 microns with a GSD of 1.21. The toner was comprised of 87.6 percent of resin (i) 3.7 percent of the above PMA wax (ii) and 8.7 percent of Yellow 14 pigment.

Example III

Magenta Toner

To 310 grams of the above latex of 40 percent solids comprising styrene/butylacrylate/sodium styrene sulfonate submicron resin particles of 190 nanometers in size suspended in an 60 percent aqueous (water) media was simultaneously added with 100 grams of a dilute pigment dispersion comprising 25 grams of PR 81.3 pigment stabilized by polypropylene maleic anhydride (PMA) wax (Dispersion #1) submicron particles (35 weight percent pigment and 15 weight percent PMA wax particles) and 75 grams of water, to 500 grams of water, while being polytroned at 3000 RPM. 15 Grams of an aqueous acidified inorganic cationic coagulant of aluminum sulfate solution containing 3.0 grams of aluminum sulfate, 11 grams of water and 1.0 grams of 0.5 weight percent nitric acid, pH=2.5 was added to the above latex pigment mixture and polytroned for 3 minutes. The mixture was then transferred into a reaction kettle and heated to 49° C. for a period of 140 minutes where the particle size as measured on a Coulter Counter was 5.9 microns with a GSD of 1.20. The pH of the slurry was then adjusted from a pH of 2.5 to a pH of 7.5 with the addition a 4 weight percent aqueous NaOH solution. The temperature of the reaction kettle was raised to 85° C. and held there for 30 minutes. The aggregate, particle size measured was 5.8 microns with a GSD of 1.20. The temperature of the reactor was then further raised to 90° C. and held there for 30 minutes resulting in a particle size of 5.9 microns and a GSD of 1.20. The pH of the reaction mixture was then slowly reduced down to 6.0 with 2.5 weight percent of dilute nitric acid. After an additional 30 minutes the pH was further reduced to 5. An additional 120 minutes at 90° C. resulted in smooth toner particles and the toner shape factor was considered to be 115 as measured by a scanning electron microscope, where a shape factor of 120 is considered to be perfectly spherical with a very smooth surface. The toner particle size after cooling the reactor contents was found to be 5.9 microns with a GSD of 1.20. The toner was comprised of 90.8 percent of resin (i), 2.8 percent of PMA wax (ii)and 6.4 percent of Process Red 81.3 pigment, and which toner possessed excellent fuser release characteristics.

Example IV

Cyan Toner—Dispersion #2

A cyan P.B. 15.3 toner was prepared in accordance with the procedure of Example I using the wax dispersion #2. The resulting toner was comprised of 92.5 percent of resin (i), 2.2 percent of PMA wax (ii) and 5.2 percent of P.B 15.3 pigment.

Example V

Yellow Toner—Dispersion #2

A Yellow 14 toner was prepared in accordance with the procedure of Example I using the wax dispersion #2. The toner was comprised of 87.6 percent of resin (i), 3.7 percent of PMA wax (ii) and 8.7 percent of Yellow 14 pigment.

Example VI

Magenta Toner—Dispersion #2

A magenta toner was prepared in accordance with the procedure of Example I using the wax dispersion #2. The toner was comprised of 90.8 percent of resin (i), 2.8 percent of PMA wax (ii) and 6.4 percent of PR 81.3 pigment Other embodiments and modifications of the present invention may occur to those of ordinary skill in the art subsequent to a review of the present application and the information presented herein; these embodiments, modifications, and equivalents, or substantial equivalents thereof, are also included within the scope of the present invention.

What is claimed is:

1. A process for the preparation of toner comprising:

(i) generating by emulsion polymerization in the presence of an initiator a resin latex emulsion;

(ii) selecting a functionalized wax capable of dispersing or dissipating in water at suitable pH in the range of from about 2 to about 10;

(iii) mixing the functionalized wax of (ii) with a colorant resulting in a wax/colorant blend, followed by dispersing the wax/colorant blend in water in acid or basic pH conditions to provide a wax/colorant coated dispersion and wherein said colorant is coated with said wax;

(iiib) mixing the resin latex emulsion of (i) with the wax/colorant mixture of (iii) to provide a blend of a resin, wax and colorant;

(iv) adding an inorganic cationic coagulant solution of a metal salt to the resin, wax and colorant blend of (iiib);

(v) heating at a temperature of from about 5 to about 10 degrees Centigrade below the resin Tg of (i), to thereby form aggregates particles and which particles are at a pH of from about 2 to about 3.5;

(vi) adjusting the pH of (v) to about 6.5 to about 9 by the addition of a base;

(vii) heating at a temperature of from about 5° C. to about 50° C. above the Tg of the resin of (i), followed by a reduction of the pH to from about 2.5 to about 5 by the addition of an acid thereby resulting in coalesced toner (viii) optionally isolating the toner.

2. A process in accordance with claim 1 wherein subsequent to (vi) there is added an additional latex comprised of water and a resin generated by emulsion polymerization.

3. A process in accordance with claim 2 wherein subsequent to the addition of said latex there is formed a coating on the aggregates obtained in (v).

4. A process in accordance with claim 1 (ii) wherein the selected functionalized wax is optionally dispersed in warm water at a temperature of about 50° C. to about 90° C. and at acid or basic pH conditions thereby resulting in a wax dispersion which dispersion is then added to said colorant and mixed providing a colorant/wax dispersion.

5. A process in accordance with claim 1 wherein (iv) is accomplished by stirring and then subjecting the blend to high shear to form a homogeneous gel.

6. A process in accordance with claim 1 wherein (iv) is accomplished by continuous stirring while subjecting the blend to high shear, to primarily form a homogeneous gel.

7. A process in accordance with claim 1 wherein the toner is isolated, and optionally wherein the toner is washed and dried.

8. A process in accordance with claim 1 wherein the toner is comprised of resin, colorant and wax.

9. A process in accordance with claim 1 whereas in (vii) the pH is from 3 to 5.

10. A process for the preparation of a toner comprising:

(i) generating by emulsion polymerization in the presence of a water soluble initiator, a latex emulsion, comprising sub micron resin particles;

(ii) selecting a functionalized wax containing either an anionic or a cationic functionally and which is dispersed in water in basic or acidic pH conditions to provide submicron wax particles in the optional size range of about 80 to about 200 nanometers;

(iii) mixing (ii) and a colorant wherein there is formed a coating of wax (ii) on said colorant thereby providing a stable colorant/wax dispersion wherein optionally from about 80 to about 95 percent of colorant is coated by said wax;

(iv) blending the resin latex emulsion of (i) with the colorant/wax dispersion (iii), to form a resin latex, colorant and wax blend;

(v) adding an aqueous inorganic cationic coagulant solution of a metal salt to the resin latex/colorant-wax blend (iv), while optionally continuously subjecting the blend to high shear to induce a homogeneous resin/colorant/wax blend;

(vi) heating the sheared gel of (v) at a temperature of from about 5° C. to about 10° C. below the resin (i) glass transition temperature while optionally continuously stirring to form aggregates of resin, coagulant and colorant;

(vii) optionally retaining (vi) for a period of from about 1 to about 3 hours to primarily minimize growth of the aggregates and achieve a narrow GSD of from about 1.15 to about 1.24;

(viii) optionally adding a further latex comprised of resin(i), wherein the addition of said latex enables the formation of a coating on the said aggregates of (vii);

(ix) changing the pH of said aggregates of (viii) which is in the range of from about 2 to about 3.5 to a pH in the range of about 6.5 to about 9 by the addition of a base to thereby primarily stabilize the aggregate particles from further growth;

(x) heating the aggregate particles of (ix) at a temperature of from about 5° C. to about 50° C. above the Tg of the resin (i), followed by a reduction of the pH from about 6.5 to about 9 to a pH of about 2.5 to about 5 with an acid to form coalesced particles of a toner composition of resin colorant and wax; and (xi) optionally separating the toner.

11. A process in accordance with claim 10 wherein said submicron (i) is from about 50 to about 250 nanometers in diameter; said warm is from about 60° C. to about 85° C.; said wax of (ii) is dispersed in warm water at a basic pH where said basic is from 7 to 9 or an acid pH, where said acid is from 4 to 6.8 resulting in a wax dispersion of a particle size in the range of 80 to 200 nanometers in diameter and wherein the dispersion of (ii) is selected as dispersant for the colorant particles to provide a stable colorant-wax dispersion, by optionally grinding the said colorant particles in the wax dispersion of (ii) resulting a colorant-wax dispersion comprised of a colorant particles with a wax coating in water, and wherein the coating thickness of said wax (iii) is from about of 10 to about 120 nm in thickness, the coating of said additional latex (viii) after the formation of the aggregates is in the range of from about 0.1 (100 m) to 1.0 (1000 nm) micron in diameter and wherein the components of the final toner are (a) resin from latex of (i), (b) wax from (ii), (c) resin from (viii), and (d) colorant coated with a wax and wherein the toner optionally contains the following amount ranges resin from (i)—from about 94 to about 85 weight percent colorant—from about 4 to about 10 weight percent wax from (ii)—from about 2 to about 5 weight percent and resin (viii) and wherein the total thereis is about 100 percent.

12. A process in accordance with claim 10 wherein the latex of (i) comprises submicron resin particles of styrene-butylacrylate-sodium styrene sulfonate which sulfonate optionally functions as a dispersant for said sub micron resin particles thereby providing a stable latex.

13. A process in accordance with claim 10, wherein the pH during the blending and the aggregation (iv) to (viii) is in the range of about 1.8 to 4.5 or is in the range of about 2 to about 4.

14. A process in accordance with claim 10 wherein the acidic pH range is from about 1.8 to about 4 and enables a narrow particle size distribution of said toner aggregates of (vi), wherein the size distribution thereof is in the range of from about 1.16 to about 1.24.

15. A process in accordance with claim 10 wherein the latex (viii) is comprised of the same polymer resin composition as that of (i) or a different polymer composition and/or different molecular properties of molecular weight, molecular number, molecular weight distribution and the resin Tg than that of (i), thereby providing a core shell structure on the toner particles.

16. A process on accordance with claim 1 wherein said colorant is a pigment, a dye or mixtures thereof.

17. A process in accordance with claim 1 wherein the prepared colorant-wax dispersion is added to the resin latex emulsion over a period of 2 to 15 minutes during blending.

18. A process in accordance with claim 1 the inorganic cationic coagulant is selected from the group consisting of metal sulfates, metal nitrates, and metal chlorides.

19. A process in accordance with claim 1 wherein said inorganic coagulant is poly aluminum chloride, poly aluminum sulfosilicate, aluminum sulfate, magnesium sulfate, zinc sulfate, potassium aluminum sulfate, calcium acetate, calcium chloride, calcium nitrate, zinc acetate, zinc nitrate, aluminum chloride each optionally present in an amount of from about 0.05 to about 10 weight percent of the toner.

20. A process in accordance with claim 1 where the wax functional group is a carboxylic acid, an amine, or an amide.

21. A process in accordance with claim 1 wherein the functionalized wax is modified by providing functional ionic groups on polyethylene, or polypropylene polyethylene, or polypropylene modified with the incorporation of maleic an ahydride; or wherein the wax is polyethylene/amide, stearamide, methylol stearamide, ethylenebis stearamide, steric acid, imides, esters, quatemary amines, carboxylic acids or an acrylic polymer and with acid numbers in the range of about 30 to about 250.

22. A process in accordance with claim 1 wherein the latex resin of (i) is selected from a group consisting of poly(styrene-acrylate), poly(styrene-butadiene), poly(para-methyl styrene-butadiene), poly(meta-methyl styrene-butadiene), poly(alpha-methylstyrene-butadiene), poly (methylmethacrylate-butadiene), poly(ethylmethacrylate-butadiene), poly(propylmethacrylate-butadiene), poly (butylmethacrylate-butadiene) poly(methylacrylate-butadiene), poly(ethylacrylate-butadiene), poly (propylacrylate-butadiene), poly(butylacrylate-butadiene), poly(styrene-isoprene), poly(para-methyl styrene-isoprene), poly(meta-methyl styrene-isoprene), poly(alpha-methylstyrene-isoprene), poly(methylmethacrylate-isoprene), poly(ethylmethacrylate-isoprene), poly (propylmethacrylate-isoprene), poly(butylmethacrylate-isoprene), poly(methylacrylate-isoprene), poly (ethylacrylate-isoprene), poly(propylacrylate-isoprene), and poly(butylacrylate-isoprene) copolymers.

23. A process according to claim 10 wherein the heating in (vi) is at a temperature of from 5° C. to 10° C. below the glass transition temperature (Tg) of the latex emulsion resin of (i) and the stirring is at speeds between about 200 and about 800 rpm to form aggregates of a diameter of from about 3 to about 10 microns with a narrow GSD in the range of from about 1.10 to about 1.25.

24. A process according to claim 10 wherein the heating in (x) is conducted at a temperature of from about 5° C. to about 50° C. above the glass transition temperature (Tg) of the resin of (i) to form toner particles comprised of styrene-butylacrylate-sodium styrene sulfonate a colorant, and a functionalized wax.

25. A process according to claim 10 wherein the latex resin dispersion of (i) contains resin particles with an average size diameter of from about 180 to about 290 nanometers.

26. A process in accordance with claim 10 wherein the high shear in (v) is from 3,000 to 10,0000 rpm for about 1 to about 120 minutes, wherein the high shear (v) is accomplished by a homogenizer, or a microfluidizer, and wherein the toner obtained possesses an average volume diameter of from about 3 to about 15 microns.

27. A process in accordance with claim 1 wherein the initiator is a water soluble initiator of ammonium persulfate, potassium persulfate, sodium persulfate, ammonium persulfite, potassium persulfite, sodium persulfite, ammonium bisulfate, potassium bisulfate, sodium bisulfate, 1,1'-azobis(I-methybutyronitrile-3-sodium sulfonate, or 4,4'-azobis(4cyanovaleric), optionally selected in the amount of about 0.1 to about 10 weight percent of the monomer to be polymerized.

28. A process for the preparation of toner comprising:

(i) forming by emulsion polymerization in the presence of an initiator a resin latex dispersion of styrene/butylacrylate/methylacrylate/sodium styrene sulfonate resin particles in water and wherein said resin is optionally submicron and in the size range of about 50 to about 250 nanometers;

(ii) selecting a functionalized wax containing either an anionic or a cationic functionally, which is then dispersed in water in basic or acidic pH conditions to provide submicron wax particles in the size range of about 80 to about 200 nanometers followed by mixing (ii) and a colorant wherein there is formed a coating of wax (ii) on said colorant thereby providing a stable colorant/wax dispersion;

(iii) wherein the dispersion of (ii) is then utilized to stabilize the colorant particles resulting in a colorant dispersion;

(iv) blending the resin latex dispersion with the colorant dispersion;

(v) adding an aqueous inorganic cationic coagulant solution of a metal salt to the wax/colorant while optionally continuously subjecting the blend to high shear, to induce a homogeneous gel of the resin/colorant blend;

(vi) heating the sheared gel at temperature of about 5 to 10 degrees Centigrade below the resin glass transition temperature (Tg);

(vii) optionally adding a further latex followed by;

(viii) changing the pH of the mixture (vi) of about 2 to about 3 to about 6.5 to about 9 with a base;

(ix) heating the aggregate particles at temperatures of 5° C. to 50° C. above the Tg of the resin, by a reduction of the pH from the range of 6.5 to 9 to about 2.5 to about 5 with an acid to form coalesced particles of a toner composition with a smooth surface;

(x) optionally separating and drying the toner.

29. A process in accordance with claim 4 the functionalized wax particles forms a coating on the colorant particles thereby providing a colorant dispersion.

30. A toner process comprising mixing a functionalized wax with a colorant and a resin latex emulsion; adding an inorganic cationic coagulant; heating below the latex resin Tg; adjusting the pH to basic; and heating above the latex resin Tg.

* * * * *